US005401364A

United States Patent [19]

Rinker

[11] Patent Number: 5,401,364

[45] Date of Patent: Mar. 28, 1995

[54] PROCESS FOR TREATING NONCAKING, NONCOKING COAL TO FORM CHAR WITH PROCESS DERIVED GASEOUS FUEL HAVING A VARIABLY CONTROLLABLE CALORIFIC HEATING VALUE

[75] Inventor: Franklin G. Rinker, Perrysburg, Ohio 43551

[73] Assignee: SGI International, Inc., La Jolla, Calif.

[21] Appl. No.: 219,529

[22] Filed: Mar. 28, 1994

Related U.S. Application Data

[63] Continuation-in-part of Ser. No. 29,556, Mar. 11, 1993, abandoned.

[51] Int. Cl.[6] ..... G10B 49/20

[52] U.S. Cl. ..... 201/1; 201/27; 201/29; 201/37; 201/41

[58] Field of Search ..... 201/27, 29, 37, 41, 201/43, 1

[56] References Cited

U.S. PATENT DOCUMENTS

| | | | |
|---|---|---|---|
| 3,177,128 | 4/1965 | Vartanian | 201/29 |
| 3,705,086 | 12/1972 | Schmalfeld et al. | 201/34 |
| 4,134,794 | 1/1979 | Lorenz et al. | 201/27 |
| 4,445,976 | 5/1984 | LaDelfa et al. | 201/41 |

*Primary Examiner*—Joye L. Woodard

*Attorney, Agent, or Firm*—Willian Brinks Hofer Gilson & Lione

[57] ABSTRACT

According to this invention there is provided a process for the heat treatment of noncaking, noncoking coal with a process derived gaseous fuel having a variably controllable calorific heating value.

17 Claims, 3 Drawing Sheets

PROCESS FOR TREATING NONCAKING, NONCOKING COAL TO FORM CHAR WITH PROCESS DERIVED GASEOUS FUEL HAVING A VARIABLY CONTROLLABLE CALORIFIC HEATING VALUE

This application is a continuation-in-part of applicant's copending application Ser. No. 08/029,556, filed Mar. 11, 1993, which application is now abandoned.

FIELD OF THE INVENTION

This invention relates to a beneficiation process for treating noncaking, noncoking coal to form char utilizing process derived gaseous fuel. More particularly, this invention relates to a process for treating noncaking, noncoking coal to form char with high sensible heat oxygen deficient gas streams produced by the selective combustion of process derived gaseous fuel having a variably controllable calorific heating value.

BACKGROUND OF THE INVENTION

A principal objective of coal beneficiation is to increase the calorific heating value or amount of thermal energy of the coal which may be released during a subsequent combustion process.

One method of increasing the thermal energy released during combustion of coal is to decrease the amount of moisture by subjecting the coal to a drying process. It will be appreciated that moisture in coal has no heating value and, although not environmentally harmful, facilitates depletion by evaporation of a portion of the thermal energy released during combustion of coal.

Another known method of increasing the thermal energy released during combustion of coal is to decrease the amount of volatile matter within the coal. The amount of volatile matter within coal may be decreased by subjecting the coal to mild gasification by pyrolysis. Pyrolysis of coal in an oxygen deficient atmosphere removes volatile matter, e.g. low boiling point organic compounds and heavier organic compounds, by breaking chemical bonds during the heating process. Breaking of chemical bonds within coal during the heating process increases the relative percentage of elemental carbon which provides most of the calorific heating value when coal is burned.

Although various methods of increasing the thermal energy released during combustion of coal are known, many of the known methods require large volumes of continuously flowing streams of oxygen deficient gas for convective heat transfer. An oxygen deficient gas as used herein refers to a gas having generally less than 5% oxygen by weight.

Heretofore, oxygen deficient gas streams have typically been produced using well known air separation technologies such as cryogenic distillation, membrane separation and pressure swing absorption. Although the known methods of producing oxygen deficient gas streams for coal drying and mild gasification processes have been proven to perform satisfactorily in certain applications, these technologies are cost ineffective when considered for large processing needs like mild coal gasification, coke preheating and the like. Large mild coal gasification systems may range up to 8,000 square feet and may use 5,000 to 10,000 standard cubic feet of oxygen deficient gas per hour per square foot of cross section for thermal treatment of coal and or oil shale whether the coal and or oil shale is to be dried or fractioned into solid and gaseous phase components.

The present invention is directed to a process for treating noncaking, noncoking coal to form char. The process employs high sensible heat oxygen deficient gas streams for consecutive drying and pyrolytic coal treatment processes. The high sensible heat containing gas streams are renewed using products of combustion from the combustion of a process derived gaseous fuel having a variably controllable calorific heating value. The calorific heating value of the process derived gaseous fuel may be controlled by selectively varying the condensation and removal of hydrocarbon components from the process derived gaseous fuel as required in accordance with the present invention.

It will be appreciated that the mild gasification process, albeit a thermal process, for the formation of char starts with a noncaking, noncoking coal and differs substantially from a process utilized for the formation of coke. The essential difference and the subject of this invention is the operability of a mild gasification process as manifested in the ability to control both the mass flow ratio as compared with the dried coal and the temperature of the high sensible heat pyrolysis gas so as to have precise control over the residual volatile content of the char formed. It will be further appreciated that coupled with the control of the mass ratio and temperature of the pyrolysis gas stream is the need for precision control over the environmental and safety aspects of the mild gasification process. Moreover, last but not least, is the need to combust and consume all of the low calorific heating value process derived gaseous fuel so as to render the process economical to operate.

The residual volatile content of the product char must be controlled precisely so as to render the char useful for subsequent combustion in power generation, as an industrial fuel, or for a metallurgical application. Typical product char and coke analyses are presented below in Table 1. Although the difference in volatile content between char and coke is readily apparent, what is not apparent is the degree of process complexity involved in performing a partial separation of volatiles to form char when compared to a full separation of volatiles to form coke where precision control of temperature, chemical composition and mass of the gas streams is not readily defined.

TABLE 1

| | Coke[1] | Coke[1] | Char[2] | Char[2] |
|---|---|---|---|---|
| Moisture % | 0.7 | 0.8 | 1.53 | 5.00 |
| Volatile % | 2.0 | 1.4 | 26.55 | 18.67 |
| Fixed Carbon % | 85.3 | 87.1 | 66.90 | 69.26 |
| Ash % | 12.0 | 10.7 | 5.02 | 7.06 |
| Sulfur % | 0.7 | 1.1 | 0.20 | 0.20 |
| Heating Value, Btu/lb | 12,550 | 12,690 | 12,983 | 12,162 |

[1]Coke processed at 1832° F. to 2102° F.
[2]Char processed at 885° F. to 985° F.

The process includes a coal drying process and a mild coal gasification process employing, in combination, means for formation of oxygen deficient gas streams and renewal of both the sensible energy and the oxygen deficient quality of the gas streams. The present invention requires precise control of gas chemistry, gas supply temperature and advanced flammable gas and vapor handling technology.

As used herein, formation of the oxygen deficient gas streams means that the oxygen deficient gas streams, i.e. nitrogen from air, carbon dioxide from combustion and water vapor from combustion or from the drying process are formed within the system except for controlled venting. Similarly, as used herein, renewal of both the sensible energy and oxygen deficient quality of the gas streams means that gaseous fuel formed in the mild gasification process is mixed with air in a combustion chamber to release heat and to oxidize the combustible vapors and gases which result from the mild gasification process.

In accordance with the present invention, the renewal of the oxygen deficient quality of the gas streams and utilization of process derived low calorific heating value gaseous fuel facilitates the possibility of an economically feasible advanced heat treatment process for combustible materials such as gas permeable, solid carbonaceous materials.

Accordingly, one aspect of the present invention is to provide a gas combustion and renewal process for supplying large volumes of continuous flowing oxygen deficient gas streams for convection drying and mild gasification of nocaking, noncoking coal. The process combines the elements of gas recirculation, combustion of flammable vapors and gases produced in the process and certain combustion chamber gas bypass and mixing technology conducive to modulation of the gas supply temperature and gas composition. The present invention is particularly applicable for production of large continuously flowing volumes of oxygen deficient gas streams as may be required for bulk drying and mild gasification of substantially continuously flowing streams of noncaking, noncoking coal. The oxygen deficient gas streams are renewed meaning that the oxygen deficient compositions, i.e. nitrogen from air, carbon dioxide from the combustion reaction and water vapor from either the combustion reaction or from drying are utilized repetitively except for venting.

SUMMARY OF THE INVENTION

Briefly, according to this invention there is provided a process for the heat treatment of combustible materials such as gas permeable, solid carbonaceous materials. The process includes the steps of combusting a controlled admixture of fuel, air and process derived gaseous fuel to form products of combustion. Unless otherwise indicated, as used herein the term "fuel" refers to any material that is burnt to release thermal energy whether the "fuel" is a process derived gaseous fuel, or an externally supplied auxiliary fuel, e.g. methane, or a combination of the two. The oxygen deficient products of combustion are then admixed with various gas streams to form attemperated high sensible heat process gas streams containing no more than 5% by weight oxygen. For the typical heat treatment process, the combustible materials are then dried in this oxygen deficient atmosphere, such as the high sensible heat process gas stream described. High sensible heat oxygen deficient gas dries the combustible materials to remove moisture therefrom and thereby remove thermal energy from the high sensible heat oxygen deficient gas to form low sensible heat gas. High sensible heat oxygen deficient gas is also utilized to pyrolyze the dry combustible materials to form char and also thereby remove thermal energy from the high sensible heat oxygen deficient gas to form low sensible heat pyrolyzer gas and process derived gaseous fuel gas. The low sensible heat process derived gaseous fuel is then controllably utilized for combustion with the fuel and air and for admixing with the resultant products of combustion for renewal.

In a preferred embodiment, the products of combustion are formed by combustion of an auxiliary fuel, such as methane, and oxygen and process derived gaseous fuel within a first combustor and a second combustor. In operation, the products of combustion from the first combustor are admixed with low sensible heat pyrolyzer gas and process derived gaseous fuel to form a high sensible heat oxygen deficient gas for pyrolysis of the combustible materials whereby thermal energy is transferred from the high sensible heat oxygen deficient gas to form low sensible heat pyrolyzer gas and process derived gaseous fuel. The low sensible heat process derived gaseous fuel may then be directed to the first combustor and/or second combustor for renewal and/or bypass the first combustor for admixture to the products of combustion from the first combustor. Similarly, the process derived gaseous fuel is admixed with fuel and oxygen within the second combustor to form products of combustion. The products of combustion are then admixed with low sensible heat oxygen deficient dryer gas to form high sensible heat oxygen deficient dryer gas for drying of the combustible materials whereby thermal energy is transferred from the high sensible heat oxygen deficient dryer gas to form low sensible heat oxygen deficient dryer gas.

The attemperated high sensible heat oxygen deficient dryer gas stream of the present invention contains no more than 5% by weight oxygen. The inert characteristics of the dryer gas reflect the oxygen deficient characteristics of the products of combustion formed in the associated combustor, where the temperature is maintained at a temperature of between 1550 degrees fahrenheit and 2050 degrees fahrenheit and preferably between 1600 degrees fahrenheit and 1950 degrees fahrenheit. It will be appreciated that as the moisture of the combustible materials being dried might vary, it might become necessary to adjust the temperature of the products of combustion so as to meet the varying demand for attemperated high sensible heat gas process streams. An important feature of the present invention, namely modulation of the high sensible heat process gas availability for drying is afforded by virtue of having a process derived gaseous fuel of variably controlled calorific heating value.

The attemperated high sensible heat oxygen deficient pyrolyzer gas stream of the present invention contains no more than 2% by weight combustibles and preferably, no more than 2% by weight oxygen. As used herein, the term "combustible" refers to hydrocarbon molecules and other materials which can combust in the presence of oxygen and heat. The inert characteristics of the pyrolyzer gas reflect the oxygen deficient characteristics of the products of combustion formed in the associated combustor, where the temperature is maintained at a temperature of between 1550 degrees fahrenheit and 2050 degrees fahrenheit and preferably between 1600 degrees fahrenheit and 1950 degrees fahrenheit. It will be appreciated that as the removal of volatiles from the coal in the mild gasification process vary, it becomes necessary to adjust the mass flow rate of the products of combustion so as to meet the varying demand for attemperated high sensible heat pyrolyzer gas. In accordance with the present invention, modulation of the availability of high sensible heat for pyrolysis, is afforded by virtue of the ratio of process derived gaseous fuel burnt in the combustor with respect to the process derived gaseous fuel bypassing the combustor.

BRIEF DESCRIPTION OF THE DRAWINGS

Further features and other aspects and advantages of this invention will become clear from the following detailed description made with reference to the drawings in which.

DESCRIPTION OF THE PREFERRED EMBODIMENTS

Figure 1:
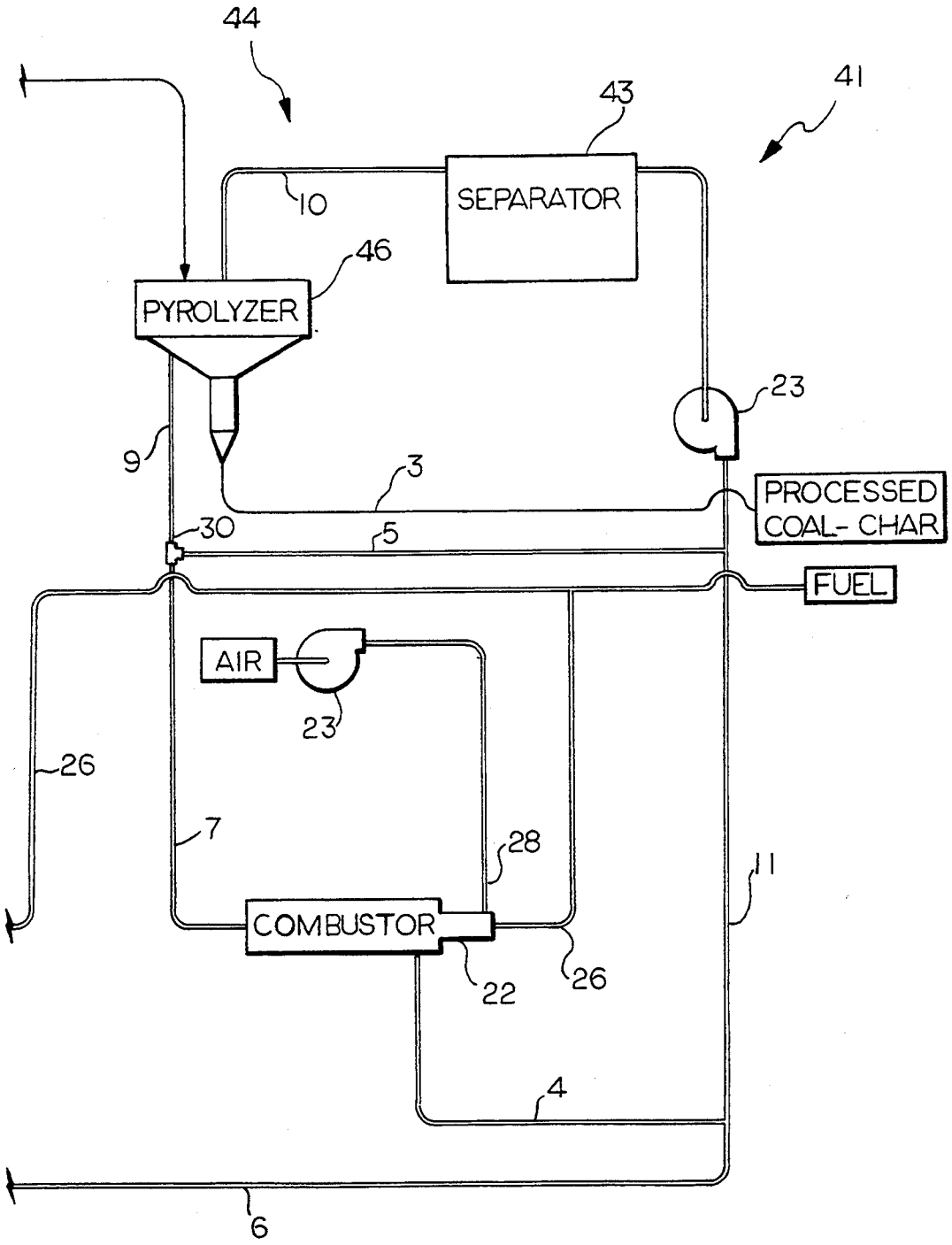
FIG. 1 is a diagrammatic presentation of the pyrolysis circuit of the present invention.
Figure 2:
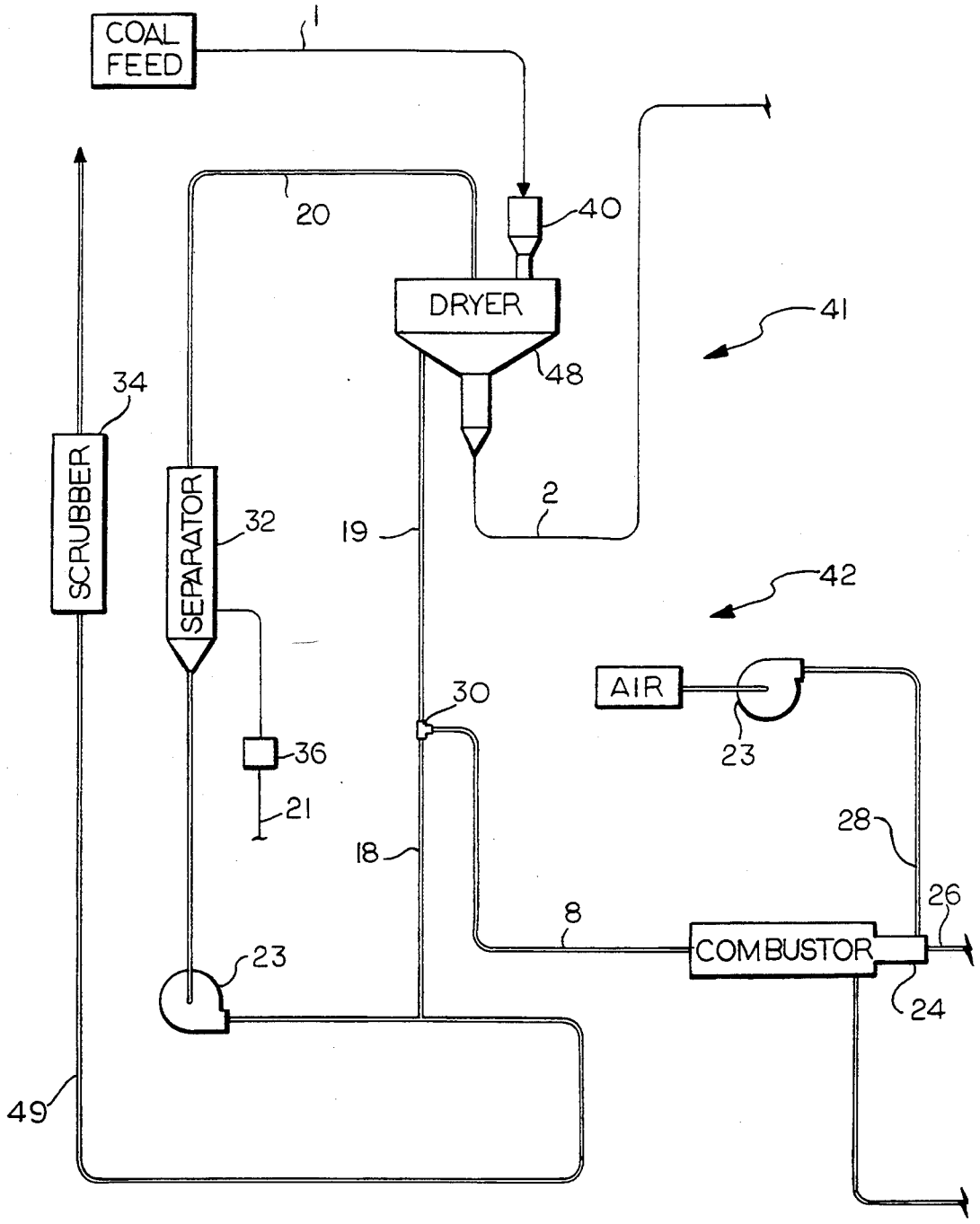
FIG. 2 is a diagrammatic presentation of the dryer circuit of the present invention.
Figure 3:
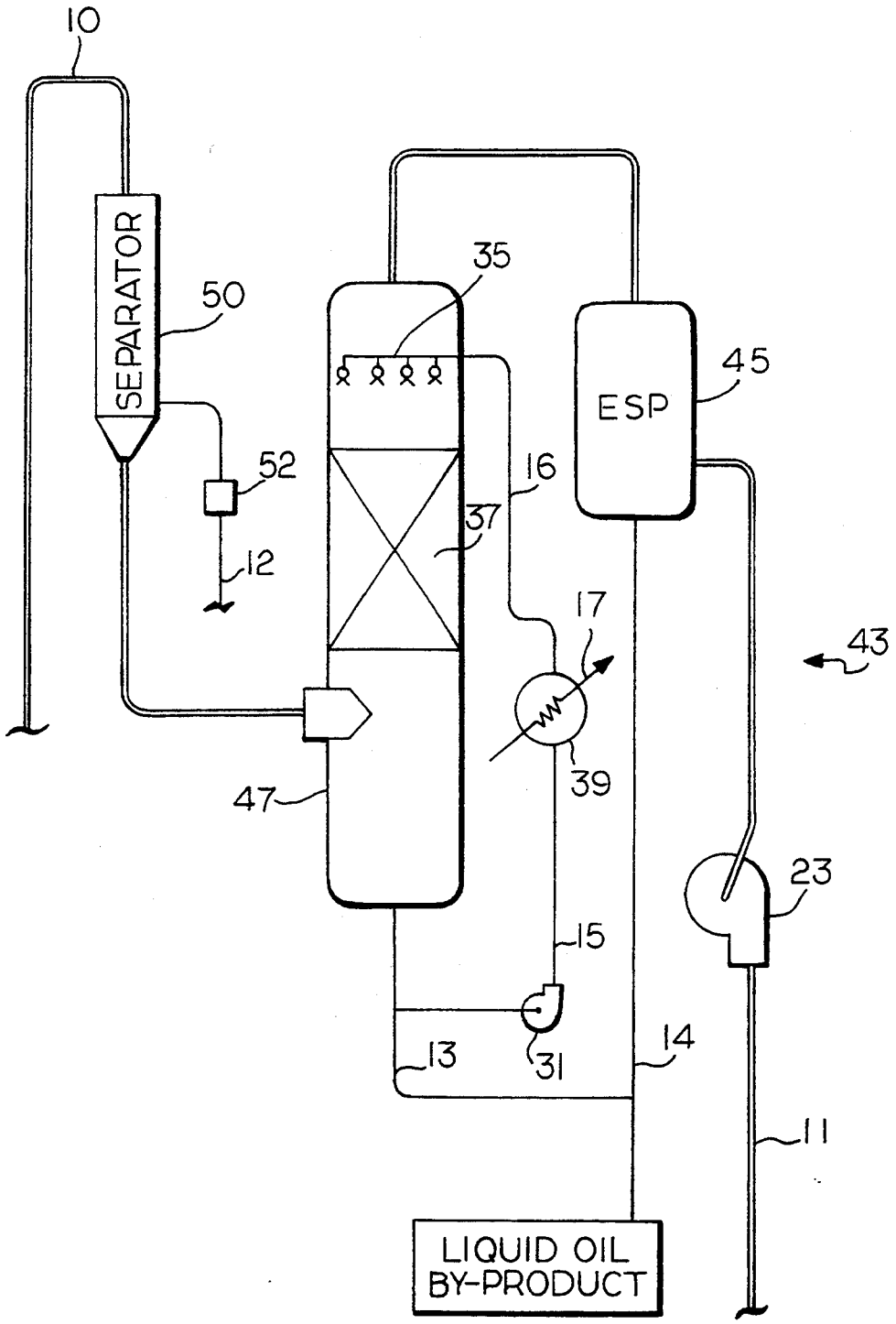
FIG. 3 is a diagrammatic presentation of a separation circuit for producing variable heat content process derived gaseous fuel.

Referring to the drawings, wherein like reference characters represent like elements, FIGS. 1, 2 and 3 depict a diagrammatic representation of a system 41 for recycling of an oxygen deficient gas stream used in the heat treatment of noncaking, noncoking coal to form char in accordance with the present invention. The system 41 comprises, in combination, a drying process 42, a mild gasification process 44 for heat treatment of noncaking, noncoking coal to form char utilizing an oxygen deficient gas stream and a separation process 43 for removal of desirable coal derived liquid and recovery of process derived gaseous fuel having a variably controllable calorific heating value.

In considering FIGS. 1, 2 and 3, it will be appreciated that for purposes of clarity the details of construction are not provided in view of such details being conventional and well within the skill of the art once the invention is disclosed and explained. Reference is made to Perry and Chilton, CHEMICAL ENGINEERS' HANDBOOK, 5th Edition, McGraw Hill, New York, 1973, and to the chemical processing industry literature generally for detailed descriptions on the various apparatus and processing structures and conditions. For example, a pyrolyzer 46, a dryer 48, blowers 23, pump 31, quench tower 47, fines outlet valves 36, interconnecting piping and flow control valves may be any such known commercially available components with the exception that such components may be modified as necessary by one skilled in the art to be employed in the overall system 41 of the present invention as discussed herein. In addition, many control devices which are conventional and standard in chemical processing have been omitted for clarity of illustrating and describing the invention. For example, control valves, thermocouples, thermistors, coupled with suitable servo circuits are readily available and conventionally used for measuring and controlling temperature and process flow.

The present invention is designed for processing a noncaking, noncoking coal containing a high moisture content such as Western lignite coal containing approximately 25%–30% moisture by weight. The noncaking, noncoking coal may be conveyed through the process of the present invention along a conventional continuous conveyor belt (not shown), by a skip hoist, by a vibratory conveyor, pneumatically or in any other suitable manner. For efficiency, the coal may be prepared by washing, crushing and classifying to provide coal of suitable quality, quantity and particle size. Typically, coal of a size ranging from $+\frac{1}{4}$ in. to $-3$ in., preferably $+\frac{1}{4}$ in. to $-2$ in., is a suitable feed for the process of the present invention.

The process of the present invention generally includes conveying the coal to a coal dryer feed hopper 40 and dryer 48. The dryer 48 heats the coal to reduce the moisture content of the coal. The temperature of the coal is controlled below approximately 600 degrees fahrenheit so that no significant amounts of methane and/or carbon monoxide are released from the coal. The dry coal is then conveyed to a pyrolyzer 46 where the rate of heating of the solids and residence time are controlled to achieve certain desired properties of the coal, e.g. lower relative sulphur content and higher relative carbon content. During processing of the coal in the pyrolyzer 46 all remaining free moisture is removed and a chemical reaction occurs resulting in the release of volatile gaseous material and the formation of char. The char is then removed from the pyrolyzer, quenched, cooled and transferred for storage and/or conveyed for combustion in combustors as desired.

As previously described, the pyrolyzer 46 and dryer 48 may be any suitable bulk solid heat transfer device including either a rotary grate, horizontal grate, sliding grate or fluidized bed for convective heat transfer. The pyrolyzer 46 may be of any type known in the art such as a batch type pyrolyzing furnace or a continuous type pyrolyzing furnace. Batch type pyrolyzing furnaces are essentially box type furnaces and are distinguished by the types of drive mechanisms used to transfer the coal to be pyrolyzed into and out of the furnace. Insofar as continuous type pyrolyzing furnaces are concerned, there are essentially three types of furnaces. One of the most common is a rotary kiln pyrolyzer which includes a horizontal rotating cylinder with the coal material to be heated tumbled on the inside. A helical auger is typically installed on the kiln's inside diameter thereby providing a means for transporting the coal material through the furnace. Another type of continuous pyrolyzer includes a vertical shaft and sliding bed furnace where coal is fed at the top of a cylindrical shaft and the coal is discharged at the bottom. Various bustle and tuyere arrangements are employed to treat the falling load through the furnace as a continuous fluidized bed. A third type of continuous pyrolyzer is a rotary hearth. A rotary hearth has a donut shaped hearth rotating in a stationary furnace chamber and coal is continually fed into a cold zone. A stationary spreader distributes the coal uniformly in a radial direction as the hearth rotates under a spreader. For a more detailed discussion of furnaces useful in pyrolysis reference is made to U. S. Pat. No. 4,924,785, incorporated herein by reference.

In accordance with the present invention, the oxygen deficient products of combustion gas stream utilized for drying and pyrolysis, i.e., mild gasification, of the coal material is produced by a first combustor 22 and a second combustor 24. As is well known in the art, for safety reasons, during start-up of the combustors 22 and 24, cryogenic nitrogen is supplied to purge the system 41. Prior to ignition both a fuel supply line 26 and an air supply line 28 are blocked. To provide a combustible atmosphere to ignite the combustor pilot of a type well known in the art, pilot fuel and air supplies are unblocked and a short burst of air is provided around the pilot to provide a combustible atmosphere for the pilot. While the lines 26 and 28 are blocked, fuel and air flow control valves are prepositioned to ignitable mixture settings. At the time of ignition, both fuel and air blocking valves are opened substantially simultaneously to permit the fuel and air at ignitable flow rates to nozzle mix in the presence of an igniter such as an electric ignition device and/or a fuel burning pilot. The metered fuel and air produce products of combustion 7 and 8, low in oxygen, from any one of the combustors 22 and 24 from the very onset of the combustor ignition thereby avoiding the condition of excess unburned fuel or excess oxygen flowing from the combustors during periods of ignition.

During operation, the combustors 22 and 24 are fueled with a process derived gaseous fuel 4 and 6 having a variable calorific heating value to achieve a combustion temperature between approximately 1550–2050 degrees fahrenheit, and preferably 1600–1950 degrees fahrenheit at near stoichiometric conditions thereby producing high sensible heat products of combustion 7 and 8 containing carbon dioxide, carbon monoxide, water vapor, nitrous oxides and sulphur oxides. It will be appreciated that a combustion temperature above 1550 degrees fahrenheit oxidizes potential air pollutants and below 1959 degrees fahrenheit avoids the formation of excessive amounts of nitrogen oxides.

As shown in FIG. 3, the process derived gaseous fuel 11 results from the separation of the pyrolyzer fine solids 12 and liquid oil by-product from the low sensible heat pyrolyzer gas 10. The low sensible heat pyrolyzer gas contains a variety of non-condensible gases, light hydrocarbons, oil and water. The low sensible heat pyrolyzer gas 10 is sent to the separation system 43 in which fine solids 12 are removed in a cyclone 50 with fines outlet valve 52. The low sensible heat pyrolyzer gas is then cooled and the desirable oil fraction 13 and 14 is condensed and separated in a quench tower 47 and electrostatic precipitator 45. The quench tower 47 consists of an oil distributor spray 35 and packed section 37 as well known in the art. Oil 15 and 16 is used as the liquid contacting medium in the quench tower 47 and is conveyed through pipe and cooled a heat exchanger 39 using a coolant 17 of a type well known in the art. The gas 11 exiting the electrostatic precipitator 45 contains light hydrocarbons as well as lighter oil fractions and is used as a process derived gaseous fuel stream for both combustors.

The calorific heating value of the process derived gaseous fuel 11 leaving the electrostatic precipitator 45 may be varied as a function of the quench temperature of the components of the heavy oil fraction contained in the low sensible heat pyrolyzer gas 10. Accordingly, by regulating the calorific heating value of the process derived gaseous fuel 4 and 6 fed to the combustors 22 and 24 the temperature of the products of combustion 7 and 8 from the combustors and the temperature of the high sensible heat pyrolyzer gas 9 may be varied as a function of the quench temperature as desired. It has been found that if the quench temperature is reduced more of the lighter oil fractions are removed thereby lowering the calorific heating value of the process derived gaseous fuel and conversely, if the quench temperature is increased less of the lighter oil fractions are removed thereby increasing the calorific heating value of the process derived gaseous fuel. For example, for a quench temperature of approximately 120 degrees fahrenheit the calorific heating value of the process derived gaseous fuel 11 is reduced by nearly 30%.

However, because the calorific heating value of the process derived gaseous fuel 11 may vary, the calorific heating value of the process derived gaseous fuel may be insufficient for both drying 42 and pyrolysis 44 in all applications. An auxiliary fuel such as natural gas and an oxidant such as air may be added to the second combustor 24 to maintain acceptable high sensible heat dryer gas process temperatures. The present invention monitors the second combustor 24 products of combustion for temperature and oxygen concentration and adjusts the mass flow rate of auxiliary fuel and air to the second combustor as a function of the temperature and oxygen concentration of the products of combustion. The temperature and mass flow rate of air, auxiliary fuel and process derived gaseous fuel 6 entering the second combustor 24 are also continually monitored to determine the desirable hydrocarbon concentration in the process derived gaseous fuel. If the auxiliary fuel flow rate is above a predetermined minimum flow rate required for flame safety, then the quench temperature is increased to provide a higher hydrocarbon concentration in the process derived gaseous fuel 6 to the second combustor 24. If the auxiliary fuel consumption is at the predetermined flow rate required for flame safety and the temperature of the products of combustion 8 exiting the second combustor 24 is above a predetermined set point temperature then the quench temperature is lowered to decrease the hydrocarbon concentration in the process derived gaseous fuel 6. Representative results of the effect of quench temperature on the second combustor 24 operation are provided below in Table 2.

TABLE 2

| Quench Temp. °F. | Calorific Heating Value of Process Derived Fuel From Separator 43 (MM btu/hr) | Calorific Reating Value of Process Derived Fuel To Combustor 22 (MM btu/hr) | Calorific Heating Value of Process Derived Fuel To Combustor 24 (MM btu/hr) | Oxygen Mole Fraction |
|---|---|---|---|---|
| 120 | 87.4 | 20.1 | 23.3 | 0.079 |
| 180 | 122 | 28.4 | 31.8 | 0.011 |
| 190[1] | 129 | 30.0 | 33.7 | 0.006 |
| 200 | 137 | 31.7 | 35.7 | 0.000 |
| 220 | 154 | 35.8 | 40.4 | 0.000 |

[1]Predetermined optimum set point

As shown in Table 2, a variation of 10 degrees fahrenheit in the quench temperature relative to a preselected optimum quench temperature of about 190 degrees fahrenheit results in about a 6 percent change in the calorific heating value of the process derived gaseous fuel 11 to both the first combustor 22 and the second combustor 24. However, it will be appreciated that a significant decrease in the quench temperature without a decrease in the quantity of air supplied to the first combustor 22 could lead to unacceptably high levels of oxygen in the high sensible heat pyrolyzer gas 9. Accordingly, for each variation in quench temperature, the oxygen in the products of combustion 7 from the first combustor 22 must be less than 5% and, preferably less than 1%, indicating near stoichiometric combustion. It will be further appreciated that a variation in the quench temperature also affects rather significantly the temperature of the products of combustion 7 from the first combustor 22 and the temperature of the high sensible heat pyrolyzer gas stream 9 to the pyrolyzer 46 unless additional auxiliary fuel is added to make up for the lost calorific heating value of the process derived gaseous fuel 4. For example, for a quench temperature of 120 degrees fahrenheit the calorific heating value is decreased by nearly 33%. This loss of calorific heating value can be overcome by adjusting the mass flow rate of process derived gaseous fuel 4 to the first combustor 22.

In accordance with the present invention, enhancement of the combustion process and economy of operation is achieved by mixing the process derived gaseous fuel 4 and 6 with the auxiliary fuel and air entering the first combustor 22 and second combustor 24. Accordingly, by utilizing the process derived gaseous fuel 4 and 6 and mixing the gaseous fuel with the auxiliary fuel and air, hydrocarbon vapors, carbon monoxide and hydrogen sulfide are reacted and removed from the products of combustion 7 and 8 and sensible heating value is obtained from the process derived gaseous fuel. In addition, because process derived gaseous fuel 4 and 6 is readily available, large volumes of economical high sensible heat products of combustion 7 and 8 may be produced for both drying and pyrolysis than would otherwise be possible.

The process derived gaseous fuel 11 exiting from the separation system 43 is mixed with the auxiliary fuel and air and combusted in the first combustor 22 to produce products of combustion 7 having the desired chemistry. The products of combustion 7 are then mixed with process derived gaseous-fuel 5 to attemperate the products of combustion to achieve the desired outlet temperature and mass flow rate for subsequent introduction into the pyrolyzer 46. As shown in FIG. 1, the controlled products of combustion 7 from the first combustor 22 is conveyed to a mixing tee 30 and mixed with process derived gaseous fuel 5 to form high sensible heat pyrolyzer gas 9 having a desired gas temperature. The temperature of the high sensible heat pyrolyzer gas 9 is continually monitored for the purpose of increasing or decreasing the amount of process derived gaseous fuel 5 to be mixed with the products of combustion 7. The mass flow and the temperature of process derived gaseous fuel 4, auxiliary fuel and air entering and the products of combustion 7 exiting the first combustor 22 are continuously monitored to maintain minimum and maximum combustor operating temperature requirements as previously described. The resulting products of combustion 7 exiting the first combustor 22, high in sensible heat and low in combustible and/or oxygen are mixed with the process derived gaseous fuel 5 in mixing tee 30 to form high sensible heat pyrolyzer gas 9 utilized for thermal processing of reactive noncaking, noncoking coal particles within the pyrolyzer 46.

In the pyrolyzer 46, sensible heat is transferred from the high sensible heat pyrolyzer gas 9 to the noncoking, noncaking coal thereby separating from the coal volatile matter and forming low sensible heat pyrolyzer gas 10. The volatile matter is the portion of the coal which when heated in the absence of air is liberated as gases and vapors. It will be appreciated that volatile matter does not exist by itself in coal, except for a small amount of methane, but results from thermal decomposition of the coal material by pyrolysis. It has been found that for pyrolysis of the noncaking, noncoking coal to form char, the ratio of high sensible heat pyrolyzer gas to coal is 1.5–2.5 by mass and preferably 2.0 by mass.

From the pyrolyzer 46 the low sensible heat pyrolyzer gas 10, volatile matter and solid particles are separated in a separation system 43 as previously described. The solid particles and removed volatile matter may then be transferred for storage and the process derived gaseous fuel 11 directed to the first and second combustors 22 and 24 for use as a fuel 4 and 6 and for mixing with the products of combustion 7 from the first combustor.

The drying process 42 includes a second combustor 24, a dryer 48 and, if desired, a scrubber 34. The second combustor 24 is substantially similar to the first combustor 22 in design and operation as described above to produce high sensible heat dryer gas 19 for drying the noncaking, noncoking coal material within the dryer. The products of combustion 8 from the second combustor 24 are conveyed to the dryer 48 to remove moisture from the coal thereby producing a dry high heating value noncaking, noncoking coal and a low sensible heat dryer gas 20. It has been found that for drying of the coal, the ratio of high sensible heat dryer gas 19 to coal is 3.0–6.0 by mass, and preferably 3.5 by mass.

It will be appreciated that the first and second combustors 22 and 24 also act as internal flares for environmental emission control following an unplanned shutdown with hydrocarbon vapors present in the dryer 48 or pyrolyzer 46. The thermal inertia or stored energy in the combustor refractories will serve as an auto-ignition source for the hydrocarbon vapors remaining in the system 41. Auxiliary fuel and combustion air may also be provided on a contingency basis to thermally oxidize otherwise undesirable vapors within the oxygen deficient gas 49 prior to their release from the system 41.

From the dryer 48 the low sensible heat dryer gas 20 is treated to separate solid particles 21 from the low sensible heat dryer gas exiting from the dryer within a cyclone separator 32 and valve 36 of a type well known in the art. The low sensible heat dryer gas 18 exiting from the cyclone 32 with fines valve 36 may then be either vented 49 and/or mixed with the products of combustion 8 exiting from the second combustor 24.

The second combustor 24 is continually monitored for the purpose of increasing or decreasing the quality of the oxygen deficiency of the products of combustion 8 from the second combustor. In addition, the mass flow and the temperature of process derived gaseous fuel 6 and air streams entering and products of combustion 8 exiting the second combustor 24 are continually monitored to maintain minimum and maximum combustor temperature requirements as previously described.

The invention will be further clarified by consideration of the following example in which approximately 84,000 lbs/hr of Western lignite coal was processed in accordance with the present Invention. In considering the following example, the compositions of the various process streams provided in the tables are also identified on the drawings by an arabic numeral corresponding to the particular process stream number. As shown in Table 3, the Western lignite noncaking, noncoking coal was dried and then pyrolyzed to produce a char having approximately 27% more by weight carbon and 0.1% by weight reduced sulfur.

TABLE 3

| COAL FEED-STREAM 1 | | COAL LEAVING DRYER STREAM 2 | | CHAR FROM STREAM 3 PYROLYZER | |
|---|---|---|---|---|---|
| MATTER | WT. % | MATTER | WT. % | MATTER | WT. % |
| Carbon | 49.0 | Carbon | 67.1 | Carbon | 75.9 |
| Hydrogen | 3.5 | Hydrogen | 4.8 | Hydrogen | 3.4 |
| Oxygen | 11.8 | Oxygen | 16.2 | Oxygen | 8.5 |
| Nitrogen | 0.7 | Nitrogen | 1.0 | Nitrogen | 1.2 |
| Sulfur | 0.5 | Sulfur | 0.7 | Sulfur | 0.4 |
| Ash | 5.3 | Ash | 7.2 | Ash | 10.6 |
| Moisture | 29.1 | Moisture | 3.0 | Moisture | 0 |

TABLE 3-continued

| COAL FEED-STREAM 1 | | COAL LEAVING DRYER STREAM 2 | | CHAR FROM STREAM 3 PYROLYZER | |
|---|---|---|---|---|---|
| MATTER | WT. % | MATTER | WT. % | MATTER | WT. % |
| Total lb/hr | 83,885 | Total lbs/hr | 59,490 | Total lbs/hr | 39,860 |

During start up, methane, air and process derived gaseous fuel 4 were introduced to a vitiation chamber of the first combustor 22 so as to produce products of combustion 7. The products of combustion 7 were then mixed with additional process derived gaseous fuel 5 to produce attemperated high sensible heat pyrolyzer gas 9. The compositions of process derived gaseous fuel 4 entering the first combustor 22 and mixing with the products of combustion 5 are shown in Tables 4 and 5, respectively.

TABLE 4

PROCESS DERIVED FUEL GAS TO FIRST COMBUSTOR - STREAM 4

| GAS | WT. % | GAS | WT. % | GAS | WT. % |
|---|---|---|---|---|---|
| CO | 2.1 | $C_4H_{10}$ | 0.1 | $H_2O$ | 22.5 |
| $CO_2$ | 19.0 | $C_5H_{12}$ | 0.1 | $C_7$+ | 1.8 |
| $H_2$ | 0.03 | $C_6H_{14}$ | 0.1 | SOx | 0.6 |
| $CH_4$ | 0.9 | $H_2S$ | 0.3 | NOx | — |
| $C_2H_6$ | 0.4 | $N_2$ | 51.7 | $O_2$ | — |
| $C_3H_8$ | 0.2 | $NH_3$ | 0.1 | Total lbs/hr | 34,232 |

TABLE 5

PROCESS DERIVED FUEL BYPASS AROUND FIRST COMBUSTOR - STREAM 5

| GAS | WT. % | GAS | WT. % | GAS | WT. % |
|---|---|---|---|---|---|
| CO | 2.1 | $C_4H_{10}$ | 0.1 | $H_2O$ | 22.5 |
| $CO_2$ | 19.0 | $C_5H_{12}$ | 0.1 | $C_7$+ | 1.8 |
| $H_2$ | — | $C_6H_{14}$ | 0.1 | SOx | 0.6 |
| $CH_4$ | 0.9 | $H_2S$ | 0.3 | NOx | — |
| $C_2H_6$ | 0.4 | $N_2$ | 51.7 | $O_2$ | — |
| $C_3H_8$ | 0.2 | $NH_3$ | 0.1 | Total lbs/hr | 68,157 |

The composition of the resulting high sensible heat pyrolyzer gas 9 formed by the admixture of the products of combustion 7 and process derived gaseous fuel from the first combustor is provided in Table 6.

TABLE 6

HIGH SENSIBLE HEAT PYROLYZER GAS TO PYROLYZER - STREAM 9

| GAS | WT. % | GAS | WT. % | GAS | WT. % |
|---|---|---|---|---|---|
| CO | 1.7 | $C_4H_{10}$ | 0.1 | $H_2O$ | 20.3 |
| $CO_2$ | 18.7 | $C_5H_{12}$ | 0.1 | $C_7$+ | 1.0 |
| $H_2$ | — | $C_6H_{14}$ | 0.1 | SOx | 0.6 |
| $CH_4$ | 0.5 | $H_2S$ | 0.2 | NOx | — |
| $C_2H_6$ | 0.2 | $N_2$ | 56.4 | $O_2$ | — |
| $C_3H_8$ | 0.1 | $NH_3$ | 0.1 | Total lbs/hr | 127,077 |

Additional process derived gaseous fuel 6 of a composition as shown in Table 4 was then conveyed to the second combustor 24 and controllably mixed with auxiliary fuel and air to produce products of combustion 8. The composition of the products of combustion 8 exiting the second combustor 24 is shown in Table 7.

TABLE 7

PRODUCTS OF COMBUSTION FROM SECOND COMBUSTOR - STREAM 8

| GAS | WT. % | GAS | WT. % | GAS | WT. % |
|---|---|---|---|---|---|
| CO | — | $C_4H_{10}$ | — | $H_2O$ | 16.8 |
| $CO_2$ | 19.0 | $C_5H_{12}$ | — | $C_7$+ | — |
| $H_2$ | — | $C_6H_{14}$ | SOx | 0.7 | |
| $CH_4$ | — | $H_2S$ | — | NOx | — |
| $C_2H_6$ | — | $N_2$ | 62.9 | $O_2$ | 0.6 |
| $C_3H_8$ | — | $NH_3$ | — | Total lbs/hr | 65,951 |

The high sensible heat products of combustion 8 from the second combustor 24 were then mixed with low sensible heat dryer gas 18 from the drying process 42. The compositions of the low sensible dryer gas 18 from the drying process 42 and the resultant attemperated high sensible heat oxygen deficient dryer gas 19 formed by the mixture of the low sensible heat dryer gas and the products of combustion are shown in Tables 8 and 9, respectively.

TABLE 8

DRYER GAS - STREAM 18

| GAS | WT. % | GAS | WT. % | GAS | WT. % |
|---|---|---|---|---|---|
| CO | — | $C_4H_{10}$ | — | $H_2O$ | 38.2 |
| $CO_2$ | 14.2 | $C_5H_{12}$ | — | $C_7$+ | — |
| $H_2$ | — | $C_6H_{14}$ | — | SOx | 0.5 |
| $CH_4$ | — | $H_2S$ | — | NOx | — |
| $C_2H_6$ | — | $N_2$ | 46.6 | $O_2$ | 0.4 |
| $C_3H_8$ | — | $NH_3$ | — | Total lbs/hr | 231,877 |

SOLIDS IN DRYER

| Carbon WT. % | Hydrogen WT. % | Oxygen WT. % | Nitrogen WT. % | Sulfur WT. % | Ash WT. % | Moisture WT. % | Total lbs/hr |
|---|---|---|---|---|---|---|---|
| 67.1 | 4.8 | 16.2 | 0.9 | 0.7 | 7.2 | 13.1 | 557 |

TABLE 9

HIGH SENSIBLE HEAT GAS TO DRYER - STREAM 19

| GAS | WT. % | GAS | WT. % | GAS | WT. % |
|---|---|---|---|---|---|
| CO | — | $C_4H_{10}$ | — | $H_2O$ | 33.5 |
| $CO_2$ | 15.3 | $C_5H_{12}$ | $C_7$+ | — | |
| $H_2$ | — | $C_6H_{14}$ | SOx | 0.5 | |
| $CH_4$ | — | $H_2S$ | — | NOx | — |
| $C_2H_6$ | — | $N_2$ | 50.2 | $O_2$ | 0.5 |
| $C_3H_8$ | $NH_3$ | — | Total | 297,828 lbs/hr | |

SOLIDS IN DRYER GAS

| Carbon WT. % | Hydrogen WT. % | Oxygen WT. % | Nitrogen WT. % | Sulfur WT. % | Ash WT. % | Moisture WT. % | Total lbs/hr |
|---|---|---|---|---|---|---|---|
| 67.1 | 4.8 | 16.2 | 0.9 | 0.7 | 7.2 | 3.1 | 557 |

In the pyrolyzer 46, sensible heat was transferred from the high sensible heat pyrolyzer gas stream 9 to the noncaking, noncoking coal thereby separating from the coal volatile matter. The composition of the volatile gas exiting the pyrolyzer 46 and entering the separator system 43 is provided in Table 10. The materials exiting from the separator are shown in Table 11.

TABLE 10

OVERHEAD GAS FROM PYROLYZER - STREAM 19

| GAS | WT. % | GAS | WT. % | GAS | WT. % |
|---|---|---|---|---|---|
| CO | 2.0 | $C_4H_{10}$ | 0.1 | $H_2O$ | 21.4 |
| $CO_2$ | 18.1 | $C_5H_{12}$ | 0.1 | $C_7$+ | 6.4 |
| $H_2$ | — | $C_6H_{14}$ | 0.1 | SOx | 0.6 |
| $CH_4$ | 0.9 | $H_2S$ | 0.3 | NOx | — |
| $C_2H_6$ | 0.4 | $N_2$ | 49.3 | $O_2$ | — |

TABLE 10-continued

| | | | | | |
|---|---|---|---|---|---|
| $C_3H_8$ | 0.2 | $NH_3$ | 0.1 | Total lbs/hr | 145,554 |

SOLIDS FROM PYROLYZER

| Carbon WT. % | Hydrogen WT. % | Oxygen WT. % | Nitrogen WT. % | Sulfur WT. % | Ash WT. % | Moisture WT. % | Total lbs/hr |
|---|---|---|---|---|---|---|---|
| 69.2 | 4.9 | 16.7 | 1.0 | 0.7 | 7.5 | — | 1,154 |

TABLE 11

SOLIDS FROM SEPARATOR - STREAM 13

| Carbon WT. % | Hydrogen WT. % | Oxygen WT. % | Nitrogen WT. % | Sulfur WT. % | Ash WT. % | Moisture WT. % | Total lbs/hr |
|---|---|---|---|---|---|---|---|
| 69.2 | 4.9 | 16.7 | 1.1 | 0.7 | 7.4 | — | 1,142 |

The high sensible heat dryer gas 19 entered the dryer 48 thereby removing moisture from the coal material. The composition of the low sensible heat dryer gas exiting the dryer 48 is shown in Table 12.

TABLE 12

OVERHEAD GAS FROM DRYER - STREAM 20

| GAS | WT. % | GAS | WT. % | GAS | WT. % |
|---|---|---|---|---|---|
| CO | — | $C_4H_{10}$ | — | $H_2O$ | 38.2 |
| $CO_2$ | 14.2 | $C_5H_{12}$ | $C_7$+ | — | |
| $H_2$ | — | $C_6H_{14}$ | SOx | 0.5 | |
| $CH_4$ | — | $H_2S$ | NOx | — | |
| $C_2H_6$ | — | $N_2$ | 46.7 | $O_2$ | 0.4 |
| $C_3H_8$ | — | $NH_3$ | — | Total lbs/hr | 320,446 |

SOLIDS IN GAS STREAM FROM DRYER STREAM 21

| Carbon WT. % | Hydrogen WT. % | Oxygen WT. % | Nitrogen WT. % | Sulfur WT. % | Ash WT. % | Moisture WT. % | Total lbs/hr |
|---|---|---|---|---|---|---|---|
| 67.1 | 4.8 | 16.2 | 1.0 | 0.7 | 7.2 | 3.0 | 2,338 |

The low sensible heat dryer gas 20 exiting the dryer 48 was then conveyed to a cyclone 32 to separate solid particles from the low sensible heat dryer gas and the low sensible heat dryer gas 18 was then either mixed with the products of combustion 8 from the second combustor or vented 49 after suitable treatment to remove any unwanted gaseous products.

The present invention has been illustrated with regard and specifically designed for the heat treatment of noncaking, noncoking coal such as Western lignite coal.

The publications, documents, patents and patent applications referred to herein are hereby incorporated by reference.

Having described presently preferred embodiments of the invention, it is to be understood that it may be otherwise embodied within the scope of the appended claims.

What is claimed is:

1. A process for treating noncaking, noncoking coal to form char with a process derived gaseous fuel having a variably controllable calorific heating value, the process comprising the steps of:

a) combusting a controlled admixture of fuel, air and process derived gaseous fuel within a combustor to form oxygen deficient products of combustion having a temperature between 1600 degrees fahrenheit and 1950 degrees fahrenheit;

b) admixing the oxygen deficient products of combustion from the second combustor with low sensible heat dryer gas to form attemperated high sensible heat dryer gas containing no more than 5% by weight oxygen;

c) drying the coal with the high sensible heat dryer gas to remove moisture therefrom;

d) combusting a controlled admixture of externally supplied fuel, air and process derived gaseous fuel within a first combustor to form oxygen deficient products of combustion having a temperature between 1600 degrees fahrenheit and 1950 degrees fahrenheit;

e) admixing the oxygen deficient products of combustion from the first combustor with process derived gaseous fuel to form attemperated high sensible heat pyrolyzer gas containing no more than 1% by weight oxygen;

f) pyrolyzing the dried coal with the high sensible heat pyrolyzer gas from the first combustor to form char by mild gasification and remove thermal energy from the high sensible heat pyrolyzer gas to form low sensible heat pyrolyzer gas;

g) separating from the low sensible heat pyrolyzer gas volatile matter and solid particles to form the process derived gaseous fuel for combusting within the first combustor, second combustor and for admixing with oxygen deficient products of combustion from the first combustor;

h) monitoring the drying process to determine an ideal calorific heating value of the process derived gaseous fuel to the second combustor as a function of the temperature of the high sensible heat dryer gas;

i) varying the temperature at which the low sensible heat pyrolyzer gas and volatile matter are separated so as to control the calorific heating value of the process derived gaseous fuel as a function of the temperature of the high sensible heat dryer gas;

j) directing a controlled amount of process derived gaseous fuel to the first combustor for combustion with the fuel and air to form oxygen deficient products of combustion and directing a controlled amount of process derived gaseous fuel for admixing with the oxygen deficient products of combustion from the first combustor so as to control the temperature of the high sensible heat pyrolyzer gas; and k) venting the remaining process derived gaseous fuel to the second combustor for combustion with the fuel and air and oxidation of carbon monoxide and volatile organic compounds.

2. The process of claim 1 wherein the high sensible heat pyrolyzer gas contains no more than 2% by weight combustibles.

3. The process of claim 2 wherein the high sensible heat dryer gas contains no more than 2% by weight oxygen.

4. The process of claim 3 wherein the ratio of high sensible heat pyrolyzer gas to coal entering the pyrolyzer is between 1.5–2.5 lbs/hr.

5. The process of claim 4 wherein the ratio of high sensible heat pyrolyzer gas to coal entering the pyrolyzer is approximately 2.0 lbs/hr.

6. The process of claim 5 wherein the ratio of high sensible heat dryer gas to coal entering the dryer is between 3.0–6.0 by lbs/hr.

7. The process of claim 6 wherein the ratio of high sensible heat dryer gas to coal entering the dryer is approximately 3.5 by lbs/hr.

8. The process of claim 7 wherein the noncaking, noncoking coal is a western lignite coal containing between 25–30% moisture by weight.

9. The process of claim 3 wherein the calorific heating value of the process derived gaseous fuel is varied by the selective cooling of the low sensible heat pyrolyzer gas over a temperature range of between 120 degrees fahrenheit and 220 degrees fahrenheit and the selective separation of liquid oil by-product therefrom.

10. The process of claim 9 wherein the selective cooling of the low sensible heat pyrolyzer gas is regulated to a temperature of 190 degrees fahrenheit.

11. A process for treating noncaking, noncoking coal to form char with a process derived gaseous fuel having a variably controllable calorific heating value, the process comprising the steps:

a) directing a controlled amount of process derived gaseous fuel to a first combustor for combustion with an auxiliary fuel and air to form oxygen deficient products of combustion and directing a controlled amount of process derived gaseous fuel for admixing with the oxygen deficient products of combustion from the first combustor to form a high sensible heat pyrolyzer gas having a controlled temperature;

b) venting the remaining process derived gaseous fuel to a second combustor for combustion with a fuel and air and oxidation of carbon monoxide and volatile organic compounds to form oxygen deficient products of combustion for admixing with a low sensible heat dryer gas to form attemperated high sensible heat dryer gas;

c) monitoring the drying process to determine an ideal calorific heating value of the process derived gaseous fuel to the second combustor as a function of the temperature of the high sensible heat dryer gas;

d) drying the coal with the high sensible heat dryer gas to remove moisture therefrom;

e) pyrolyzing the dried coal with the attemperated high sensible heat pyrolyzer gas to form char by mild gasification and remove thermal energy from the attemperated high sensible heat pyrolyzer gas to form low sensible heat pyrolyzer gas;

f) separating from the low sensible heat pyrolyzer gas volatile matter and solid particles to form the process derived gaseous fuel for combusting within the first combustor, the second combustor and for admixing with oxygen deficient products of combustion from the first combustor; and g) varying the temperature at which the low sensible heat pyrolyzer gas and volatile matter are separated so as to control the calorific heating value of the process derived gaseous fuel as a function of the temperature of the high sensible heat dryer gas.

12. The process of claim 11 wherein the high sensible heat pyrolyzer gas contains no more than 2% by weight combustibles.

13. The process of claim 12 wherein the high sensible heat dryer gas contains no more than 2% by weight oxygen.

14. The process of claim 13 wherein the ratio of high sensible heat pyrolyzer gas to coal entering the pyrolyzer is between 1.5–2.5 lbs/hr.

15. The process of claim 13 wherein the ratio of high sensible heat pyrolyzer gas to coal entering the pyrolyzer is approximately 2.0 lbs/hr.

16. The process of claim 14 wherein the ratio of high sensible heat dryer gas to coal entering the dryer is between 3.0–6.0 lbs/hr.

17. The process of claim 14 wherein the ratio of high sensible heat dryer gas to coal entering the dryer is approximately 3.5 lbs/hr.

* * * * *